United States Patent [19]

Wride

[11] Patent Number: 4,502,425

[45] Date of Patent: Mar. 5, 1985

[54] VARIABLE LIFT CAM FOLLOWER

[75] Inventor: Donald C. Wride, Valley View, Australia

[73] Assignee: Marlene A. Wride, Valley View, Australia

[21] Appl. No.: 420,242

[22] PCT Filed: Jan. 20, 1982

[86] PCT No.: PCT/AU82/00003

§ 371 Date: Sep. 17, 1982

§ 102(e) Date: Sep. 17, 1982

[87] PCT Pub. No.: WO82/02574

PCT Pub. Date: Aug. 5, 1982

[51] Int. Cl.[3] ..... F01L 1/24; F02D 13/02

[52] U.S. Cl. ..... 123/90.12; 123/90.16; 123/198 F; 123/345; 123/347

[58] Field of Search ..... 123/90.12, 90.15, 90.16, 123/90.17, 90.52, 90.55, 90.59, 198 F, 321, 345, 346, 347, 348

[56] References Cited

U.S. PATENT DOCUMENTS

| | | | |
|---|---|---|---|
| 1,688,164 | 10/1928 | Tarrant | 123/90.17 |
| 3,439,661 | 4/1969 | Weiler | 123/90.16 |
| 3,612,015 | 10/1971 | Hausknecht | 123/90.12 |
| 3,817,228 | 6/1974 | Bywater | 123/90.12 |
| 3,865,088 | 2/1975 | Links | 123/90.12 |
| 4,161,166 | 7/1979 | Roznovsky | 123/198 F |
| 4,261,307 | 4/1981 | Oldberg | 123/90.17 |
| 4,357,917 | 11/1982 | Aoyama | 123/90.55 |

FOREIGN PATENT DOCUMENTS

| | | | |
|---|---|---|---|
| 385731 | 4/1932 | Belgium . | |
| 1002563 | 7/1957 | Fed. Rep. of Germany . | |
| 1264857 | 3/1968 | Fed. Rep. of Germany . | |
| 2719668 | 9/1978 | Fed. Rep. of Germany | 123/198 F |
| 1529793 | 10/1978 | United Kingdom | 123/90.12 |

*Primary Examiner*—Ira S. Lazarus
*Assistant Examiner*—R. S. Bailey
*Attorney, Agent, or Firm*—Cushman, Darby & Cushman

[57] ABSTRACT

A mechanism for varying the lift and duration of lift of the valves (1) of an internal combustion engine comprises a primary hydraulic cam follower (4) actuated by a primary cam (5), a secondary hydraulic cam follower (8) actuated by a secondary cam (7), a housing (18) for the secondary cam follower (8) adjustable about the axis of the secondary cam (7) so that the timing operation of the secondary cam follower (8) can be varied, characterized in that the bleed of hydraulic oil from the primary hydraulic cam follower (4) is controlled through the secondary cam follower (8) and thereby the rate and timing of lift of the primary cam follower (4) to thus give a variation of the time and rate of opening and duration of opening of the valves (1).

4 Claims, 7 Drawing Figures

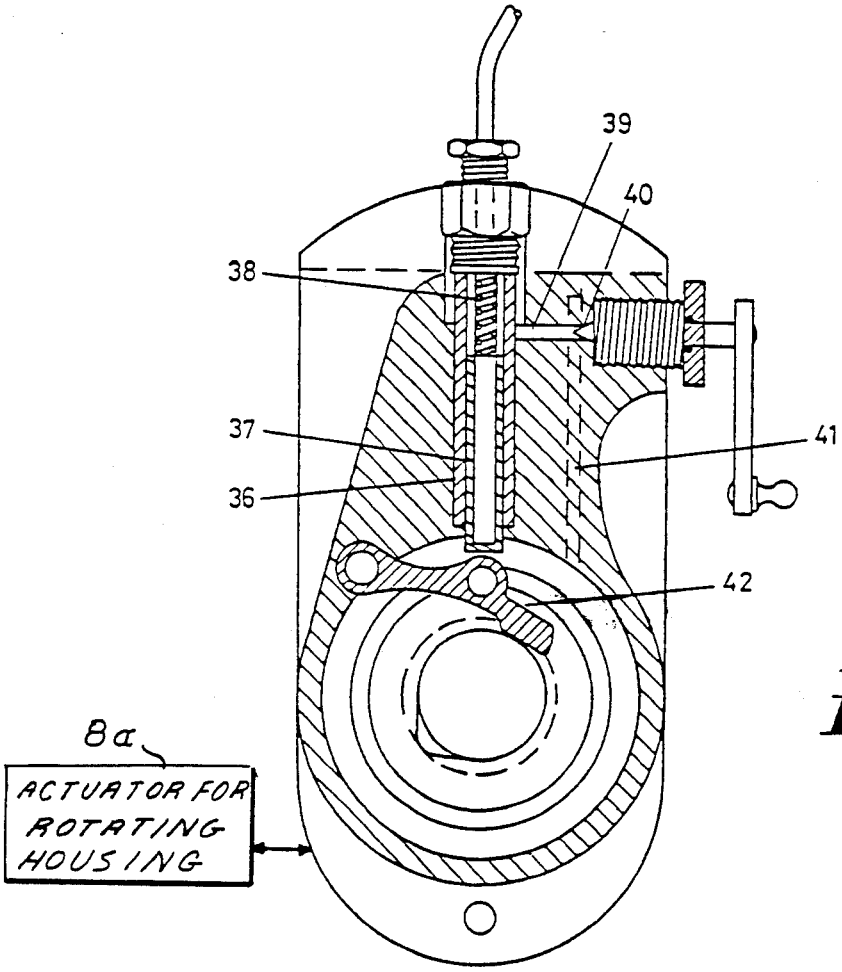
FIG 5
FIG 6
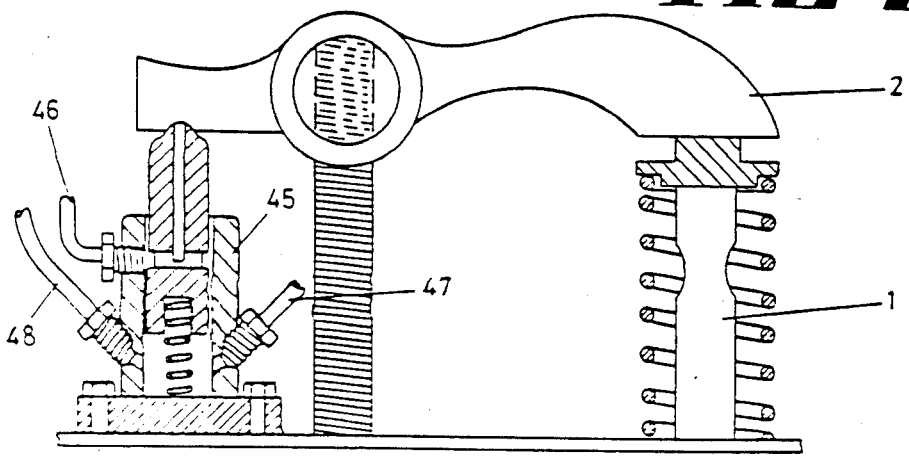

VARIABLE LIFT CAM FOLLOWER

This invention relates to hydraulic valves or hydraulic cam followers for internal combustion engines and more particularly relates to a cam follower in which a variable lift is provided to vary the opening of the valves of the internal combustion engine.

In internal combustion engines the cam shafts are usually connected in operation to the tappets of the valves, or directly to the valve stems through means which compensate for wear, temperature and other differences which would increase the amount of slack between the tappet and the cam follower.

According to a known method the tappets are operated by direct contact or through a push rod and rocker gear to a cam follower which is guided axially and positioned adjacent the cam so that it moves under the influence of the cam, spring loading being provided to return the cam follower after displacement to ensure that at all times it maintains contact with the cam.

Hydraulic cam followers are of two types, each however using a fluid such as oil to take up any slack in the action, the one type being actuated by engine oil and the other being self contained by having a sealed oil supply which takes up the necessary slack should it occur.

The principle of operation is to have between the cam follower member and the push rod or valve stem, a member which is kept extended from the cam follower by oil pressure plus spring pressure between the cam follower and this member, the arrangement however being such that over a time oil is drawn into the space between the cam follower and the inner end of the member which operates a tappet to fill this space so that when the cam pushes on the cam follower, because of the presence of oil which is sealed in this position, the cam follower and tappet member moves simultaneously. However during such motion some oil is expressed from the oil reservoir within the cam follower and the loss is replaced when the cam follower is stationary, either from engine supply or from a sealed reservoir forming a part of the cam follower assembly.

Then with these devices as used hereinbefore, motion of the cam follower is simply transmitted to the valve which it operates so that the cam follower moves the required distance such that proper opening and closing of the valve occurs. It is known also to provide a hydraulic cam follower to provide a fast lift or a high lift and in which the movement of the cam lobe itself is amplified hydraulically to give a greater movement of the valve or push rod, this movement being greater than the actual lift of the cam itself.

One form of such cam follower for actuating the valves of internal combustion engines and the like comprises a hollow cylindrical body closed at one end and slidably mounted on a sleeve fixed relative to the body, the hollow cylindrical body being formed as the cam follower to be in contact with the cam body itself. A piston is slidably mounted within the sleeve, the outer end of the piston being in engagement with the push rod, a chamber being defined between the inner end of the piston and the closed end of the body and containing hydraulic fluid. Displacement of the body by the cam displaces the hydraulic fluid which moves the piston within the fixed sleeve to give the push rod a longer and quicker stroke than the stroke of the cam or body.

However with internal combustion engines the valve timing is critical for the performance of the engine and thus if the valves are timed to give maximum performance then due to the large period of overlap of the valves and the timing of the opening of the valves and closing of the valves in relation to the piston movement these engines are difficult to run at lower speeds and poor performance is achieved at lower speeds and light loads of the engine.

Conversely if the engine is timed to have a satisfactory performance at lower speeds and to be able to idle satisfactorily then the performance suffers at higher speeds and under higher loadings.

Thus it is an object of this invention to provide a means whereby the valve timing can be varied as desired.

A further object of this invention is to provide a means whereby the valve timing can be varied automatically depending upon the operating conditions of the engine.

Thus there is provided according to this invention a variable lift cam follower comprising a hydraulic cam follower, and means to vary the lift produced by the cam follower.

In order to more fully describe the invention reference will now be made to the accompanying drawings in which:

FIG. 5 is an end view of the secondary cam follower and housing,

FIG. 6 is a view of an alternate arrangement using a variable cam shaft only.

Figure 1:
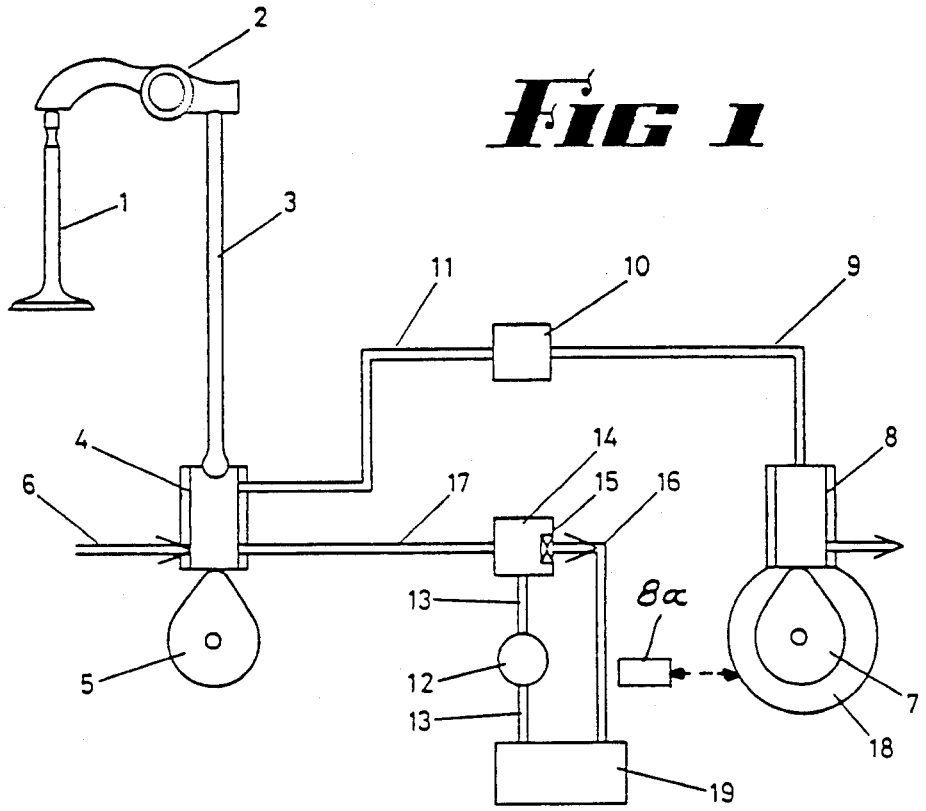
FIG. 1 is a schematic view of the invention.
Figure 2:
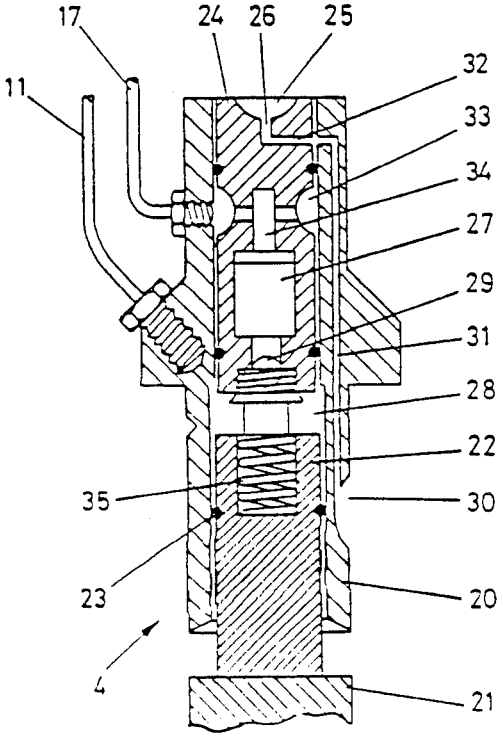
FIG. 2 is a form of primary cam follower.
Figure 3:
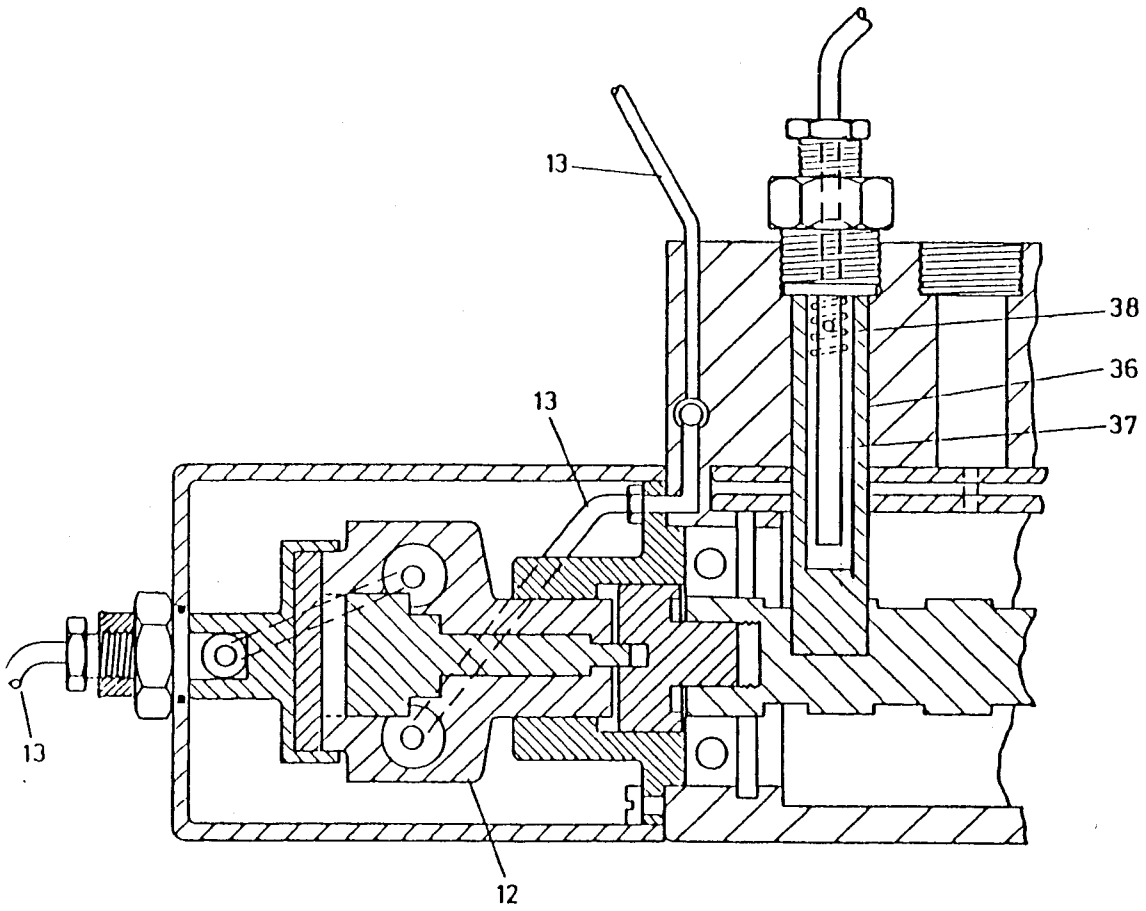
FIG. 3 is a view of part of the pump of secondary cam follower.
Figure 4:
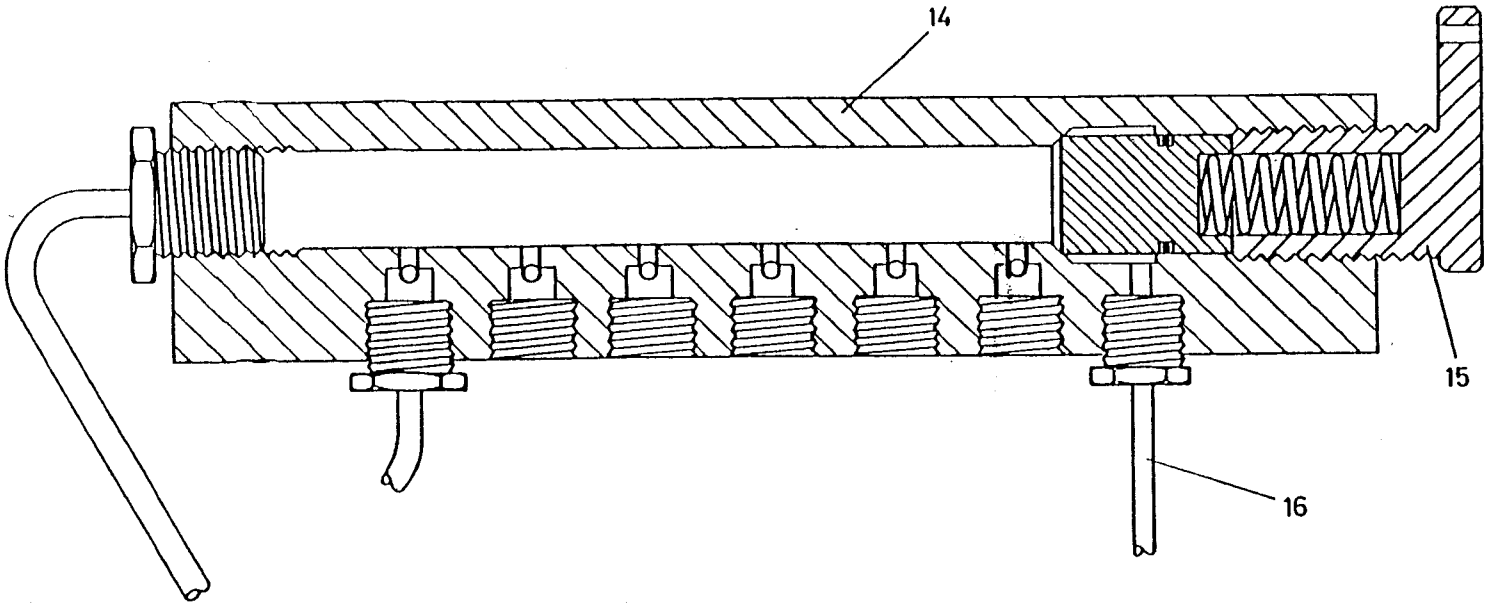
FIG. 4 is a view of the pressure block.
Figure 7:
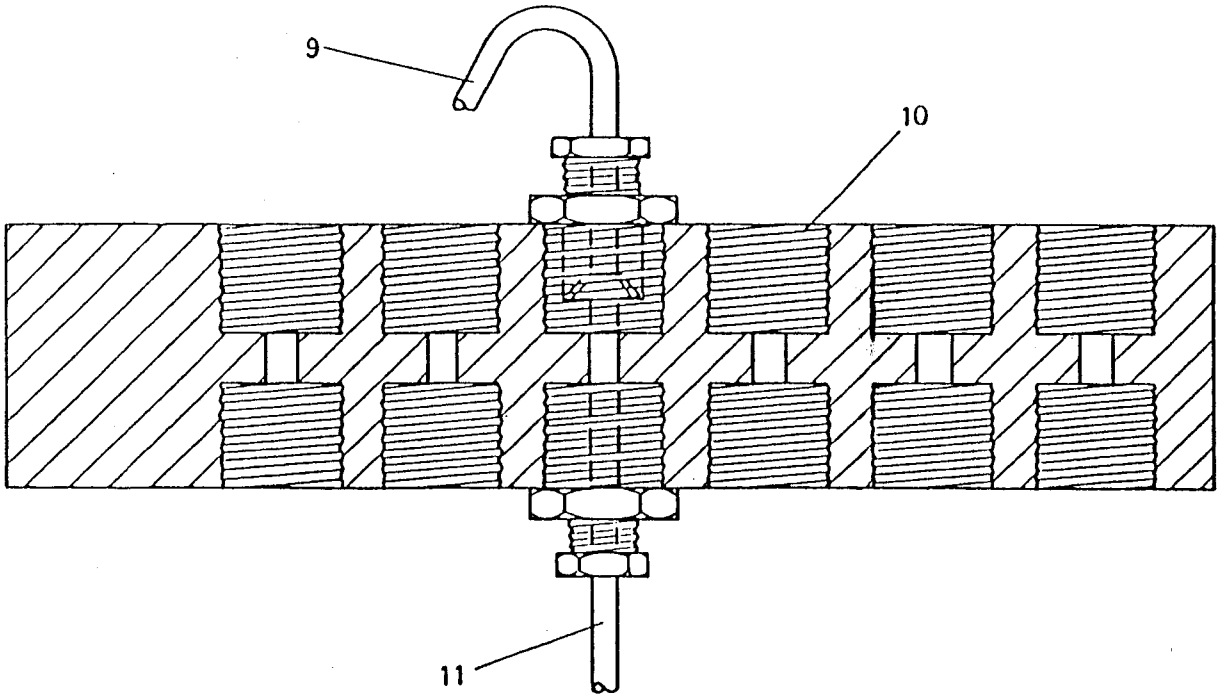
FIG. 7 is a view of a connector block.

Referring to FIG. 1, there is shown a diagramatic illustration of the invention as applied to one valve 1 of an internal combustion engine, which may be an exhaust valve or an inlet valve. The valve 1 is operated by a rocker arm 2 from a push rod 3 actuated by a primary cam follower 4 which is in contact with a primary cam 5 of the engine. As later described the primary cam follower 4 is fed by engine oil from the normal engine oil pump through inlet 6.

A secondary cam 7 actuates a secondary cam follower 8 having a hydraulic piston connected by a flexible line 9 to a connector block 10. The block 10 can be rigidly mounted on the engine and connected by hydraulic line 11 to the primary cam follower.

A secondary oil pump 12 is driven by the engine and also supplies pressure oil to the primary cam follower 4 through lines 13 to pressure valve block 14 having an adjustable relief valve 15 to provide an oil relief passage 16. The pressure side of the valve block 14 is connected by a pressure line 17 to the primary cam follower 4.

The housing 18 for the secondary cam follower 8 is adjustable about the axis of the secondary cam 7, so that the timing operation of the secondary cam follower 8 can be varied.

As later explained this variation causes the variation of the rate and timing of lift of the primary cam follower 4 to thus give a variation of the time and rate of opening and duration of opening of the valve 1. The pump 12 draws its oil from a separate reservoir 19 into which the relief passage 16 feeds.

The primary cam follower unit can be provided by a body 20 which is locked to the engine block or frame, the body being provided towards its lower end with a cam follower 21 forming a piston 22 operating in the body, a suitable seal 23 being provided between the piston portion 22 and the body portion 20.

At its upper end the primary cam follower is provided with a push rod piston 24 having a socket 25 to receive the end of the push rod.

This push rod piston 24 is provided with a through passage 26 so that oil can flow through this piston into the hollow push rod for lubricating the valve gear. The push rod piston 24 is also provided with the chamber 27 which opens into an oil reservoir space 28 between the cam follower piston 22 and the push rod piston 24, the opening from the push rod piston 24 being provided with a valve 29 to allow flow of oil from the chamber 27 into the reservoir 28 between the two pistons.

Oil is supplied to the primary cam follower from the normal lubricating system of the engine, so that the body 20 is provided with a recess 30 forming the inlet 6 to engage an oil passage in the engine, this recess communicating via a passage 31 through the body and cross passage 32 in the upper portion of the push rod piston to the passage 26 in the push rod piston to lubricate the valve gear through the hollow push rod.

Constant pressure oil is fed from pump 12 through line 17 to an inlet in the body 20 opening to groove 33 in the push rod piston leading to passage 34 opening to chamber 27 which feeds through valve 29 to fill the primary cam follower with oil.

A return spring 35 is provided between the push rod piston 24 and the cam follower piston 22 and thus when the cam follower piston 22 rises the oil trapped in the reservoir by virtue of the one way valve causes the push rod piston 24 to move upwardly and so lift the valve. The passage through the body containing the two pistons can be of stepped formation so that the push rod piston is of lesser area than that of the cam follower piston so that the push rod piston moves further than the cam follower piston to give an amplified movement to the valve gear.

In order to vary the movement of the push rod piston 24, the leakage path which is required to the reservoir from between the two pistons is sealed by the seal 23 and this leakage can be controlled through line 11 connected to the secondary cam follower 8 with the body of the secondary cam follower being able to be adjusted around the axis of the secondary cam shaft 7.

Thus the primary cam follower 4 has its piston sealed and is connected to a cylinder 36 and piston 37 in the secondary cam follower by tubing 11 to the connector block 10 that is mounted on the engine block and flexible tubing 9 to the secondary cam follower. The secondary cam shaft is preferably an identical shape to the primary cam shaft and is connected by chains or gears to the crank shaft or the primary cam shaft and is driven at the same speed as the primary cam shaft.

The pistons in the secondary unit are spring loaded by spring 38 to the cam shaft 7 and control the leakage path through bleed hole 39 adjustable valve 40 and passage 41 to the reservoir 19. Preferably this unit can be made in two separate units, the bodies 18 of which can partly revolve clockwise or anti-clockwise independently of each other about the secondary cam shaft.

One body could have within its units all the secondary cam followers for all the exhaust valves and the other have all the secondary cam followers for the inlet valves, these being in their respective firing orders. The two units are thus separated even though they are connected to the one cam shaft that extends through the primary and secondary unit.

The secondary cam follower pistons 37 may bear directly on the cam shaft 7 or alternatively as shown, the movement may be varied by a lever system shown, the lever 42 bearing on the cam shaft and also the piston whereby a lesser movement is obtained. This can preclude the formation of a special cam shaft and the conventional shaft for that particular engine may be used.

The housings of the two units can be connected to their respective vacuum control units mounted on the engine block, and/or controlled by throttle openings, engine revolutions and tail shaft speeds or in the case of stationary engines to depend on the amount of load that is on the engine.

In operation the valve 15 is adjusted to give the desired leakage rate of the oil from the secondary cam, and this leakage can be varied and set for a particular engine, and also for the desired lift of the valves. This is a controlled leakage path between piston 37 and sleeve 36 by accurate clearance. Valve 15 is to maintain an even oil pressure from low revs to high revs of engine so as not to combine with inertia and other factors to bounce the valves. Also this variation can be made to the engine depending upon whether the engine is desired to operate at a slow speed and smooth running, or whether it is desired to operate the engine at higher speeds with maximum performance.

The movement of the block of the secondary cam follower is effected by an actuating means **8*a*** which can either be manually controlled, or as described being automatic in response to the engine condition that is one or more of the following, speed, manifold pressure, throttle opening, torque, gear ratio, etc.

In an alternative embodiment the secondary cam follower need not have a ball valve therein, but the pressure fluid can be fed directly to the chamber between the pistons. Also the feeder to the push rod may only open upon movement of the push rod piston uncovering of feed port.

Thus the unit can be used to obtain a high lift valve opening at a crucial time in relation to the piston movement. Thus this control can be at the beginning of the inlet stroke where the cam is shaped to provide a gradual opening to prevent harsh pressures and wear on the valve mechanisms, but retards the intake of the fuel air mixtures and also lowers the compression of the chambers.

Thus the valve movement in relation to the piston stroke is gradually opening to full opening at half completion of the stroke and then gradual closure to completion of the stroke. The cams on the variable unit can be timed and shaped to give greater opening at the beginning of the stroke and remaining open for the duration of the stroke and give full intake of the fuel air mixture. Thus the valve can open quicker and remain open for a greater period of time.

The exhaust valve timing can also be extended to prevent pressures or vacuums in the cylinders as desired by creating a greater valve overlap.

The variable valve timing device main function is to reduce the intake capacity of the cylinders in relation to the throttle opening and the revolutions of the engine.

Both primary and secondary cams may be identical and be shaped to have an operating period of forty five degrees thus if both units are operating simultaneously then the units would have half the openings at the lower end of the stroke of the piston to full stroke by rotating the housing in the other direction. At the same time the exhaust unit would prolong the opening to cover this period.

In a further alternative the exhaust unit itself could be halved to provide two separate exhaust units and each of these are free to rotate independently of any other units. For example on a six cylinder engine, the first part of the unit would control three pistons and if the firing order of the engine were 1 5 3 6 2 4, the first unit would control pistons 1 3 and 2 and the second unit pistons 5 6 and 4. This would enable the motor to be cut back to a three cylinder engine either manually or automatically at a time when the load was minimum and the power was not needed. This would be by causing the exhaust valves to have a long period of stroke and thus a large overlap to thus cause the loading in the pistons to be reduced and become virtually ineffective. Separate exhaust systems for 132 and 564 would be needed to stop flow of working cylinders into non working cylinders.

The system on the exhaust valves could also be used for starting especially for heavy engines such as diesel engines where the exhaust valves could be controlled to stay open during the inlet stroke and most of the compression stroke to allow the starter motor to spin the motor to the required speed for starting.

In a further embodiment, (FIG. 6) the main or primary cam shaft need not be used, but the follower 45 is provided with a closed end outer member fixed to the engine block, or in the case of an overhead cam shaft engine, filter and secured to the engine head adjacent the valve stem.

The closed end follower 45 is supplied with oil from an oil feed 46, such as lubricating oil or from a separate oil supply. This supply being to the upper portion in a manner similar to the previous embodiments.

A fluid passage or line 47 connects from the closed end follower to the follower on the auxilliary cam shaft 7 through the connector block 10 with oil also being supplied from the pressure valve block 14 through line 48 so that in this way the positioning of the auxilliary cam shaft, in relation to the valve gear or valves themselves is not critical. The follower 45 thus acts on the rocker arm 49 to control valve 1.

In all of the embodiments, there is the controlled bleed from the correct operation of the valves, this bleed being necessary for the correct functioning of the valves. Although the bleed has not been described in any detail, those skilled in the act will understand that the bleed is required for the operation of the valves utilizing the invention.

It will be realized also that the oil can be fed from the engine oil sump without utilizing a separate pump. The separated pump is utilized when the invention is applied as a modification to existing engines, and if an engine is designed with the invention a single pump can be used.

Thus it will be seen that there is provided a relatively simple system which can be controlled either manually or automatically to vary the valve timing of the valves of an internal combustion engine so that the engine would run most efficiently at all speeds, this saving in fuel and also reducing the amount of pollutants passing out through the exhaust gases.

Although one form of the invention has been described in some detail it is to be realized that the invention is not to be limited thereto but can include various modifications falling within the spirit and scope of the invention.

I claim:

1. A mechanism for varying the lift and duration of lift of the valves of an internal combustion engine having a primary cam shaft operating at least one primary hydraulic cam follower, said primary hydraulic cam follower having a body, a primary cam follower piston actuated directly by said primary cam shaft, a push rod piston spaced from the said primary cam follower piston to form an oil chamber therebetween, spring means acting between said primary hydraulic cam follower piston and said push rod piston, means for feeding hydraulic fluid to said oil chamber through a one way valve, a secondary cam shaft driven by said engine, a secondary cam follower operating in a housing rotatable about said secondary cam shaft, said primary cam follower having a hydraulic bleed from said oil chamber, means connecting said bleed to said secondary cam follower to supply hydraulic fluid thereto, a secondary bleed from said secondary cam follower whereby rotation of the housing of the secondary cam follower about said secondary cam shaft controls the bleed from the primary cam follower to vary the lift and duration of lift of the push rod piston.

2. A mechanism for varying the lift and duration of lift of the valves of an internal combustion engine as in claim 1 wherein said secondary cam follower has a secondary cam follower piston operating in a cylinder in said rotatable housing, spring means biasing said secondary cam follower piston against said secondary cam shaft, said secondary bleed being controlled by an adjustable valve.

3. A mechanism for varying the lift and duration of lift of the valves of an internal combustion engine as in claim 1 wherein the internal combustion engine is a multi cylinder engine, said secondary cam follower is connected to the inlet valves of the engine being mounted in a first rotatable housing, said secondary cam follower is connected to the outlet valves of the engine being mounted in a second rotatable housing, and means for independently rotating said first and second rotatable housings about said secondary cam shaft.

4. A mechanism for varying the lift and duration of lift of the valves of an internal combustion engine as in claim 1 wherein the means to feed hydraulic fluid to said oil chamber comprises a hydraulic pump, a line connecting said pump to a pressure valve block having an adjustable valve therein to regulate the pressure to said primary cam follower and a line connecting said pressure valve block to feed hydraulic fluid through said one way valve mounted in said pushrod piston.

* * * * *